US010056720B2

(12) United States Patent
Ohashi et al.

(10) Patent No.: US 10,056,720 B2
(45) Date of Patent: Aug. 21, 2018

(54) FUSE UNIT

(71) Applicant: Yazaki Corporation, Minato-ku, Tokyo (JP)

(72) Inventors: Norihiro Ohashi, Makinohara (JP); Masayoshi Ozawa, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/832,972

(22) Filed: Dec. 6, 2017

(65) Prior Publication Data

US 2018/0166834 A1 Jun. 14, 2018

(30) Foreign Application Priority Data

Dec. 9, 2016 (JP) ..... 2016-239021

(51) Int. Cl.
*H01R 13/68* (2011.01)
*H01R 13/696* (2011.01)
*H01R 11/28* (2006.01)

(52) U.S. Cl.
CPC ..... *H01R 13/696* (2013.01); *H01R 11/287* (2013.01)

(58) Field of Classification Search
CPC ..... H01R 13/696; H01R 11/287
USPC ..... 439/620.26
See application file for complete search history.

(56) References Cited

U.S. PATENT DOCUMENTS

2015/0016028 A1* 1/2015 Darr ..... H02G 3/10 361/626
2017/0148600 A1* 5/2017 Carnick ..... H01H 85/0241
2018/0102599 A1* 4/2018 Onoda ..... H01M 2/305

FOREIGN PATENT DOCUMENTS

JP 2016-131095 A 7/2016

* cited by examiner

*Primary Examiner* — Khiem Nguyen
(74) *Attorney, Agent, or Firm* — Banner & Witcoff, Ltd.

(57) ABSTRACT

A fuse unit includes a bus bar and a housing. The bus bar includes a power source-side connection section, an output-side connection section, and a fusible body. A terminal configured to be connected to the output-side connection section includes a bent section and protrusion sections. The housing includes a terminal accommodation section for accommodating the output-side connection. The accommodation space is enclosed with side walls standing upright on both sides of the output-side connection section in an insertion direction of the terminal and on a deep side thereof in the insertion direction of the terminal. The terminal accommodation section includes terminal insertion start-side movement restricting walls and a height-direction and terminal insertion start-side movement restricting wall.

3 Claims, 8 Drawing Sheets

FUSE UNIT

CROSS REFERENCE TO RELATED APPLICATIONS

This application is based on Japanese Patent Application (No. 2016-239021) filed on Dec. 9, 2016, the contents of which are incorporated herein by reference.

BACKGROUND OF THE INVENTION

1. Field of the Invention

The present invention relates to a fuse unit, and more particularly, to a fuse unit to be installed and used in the vicinity of a battery terminal of an automobile or the like.

2. Description of the Related Art

The technology disclosed in JP-A-2016-131095, for example, is known as a technology for a fuse unit to be installed and used in the vicinity of a battery terminal of an automobile or the like.

The fuse unit 1 shown in FIGS. 1 and 2 of JP-A-2016-131095 is connected to a battery terminal 110, and a fusible body 21*c* is fused when an overcurrent flows. The fuse unit 1 is composed of a fusible link 2 including a fuse element 21 provided with the fusible body 21*c* and a holding mechanism (protector) 3 having a holding section 32 for holding the fusible link 2 on a post standing face 105.

As shown in FIG. 1 of JP-A-2016-131095, the fuse element 21 is integrally formed of a power source-side terminal 21*a* to be connected to the battery terminal 110 via a coupling bus bar 5, load-side terminals 21*b* to be connected to the load terminals 108 provided at an end parts of conducting paths (electric wires) and the fusible body 21*c* provided across the power source-side terminal 21*a* and each load-side terminal 21*b* so as to have a flat plate shape.

As shown in FIG. 2 of JP-A-2016-131095, a plurality of stud bolts 32*c* to be electrically connected to the fuse element 21 is embedded in the holding section 32. The shaft section of the stud bolt 32*c* to be connected to the power source-side terminal 21*a* is inserted into the bolt mounting holes formed so as to pass through the power source-side terminal 21*a* and the coupling bus bar 5, and these are fastened with a nut. The shaft section of the stud bolt 32*c* to be connected to the load-side terminal 21*b* is inserted into the bolt mounting holes formed so as to pass through the load-side terminal 21*b* and the load terminal 108, and these are fastened with a nut.

In recent years, as the structure around the battery of an automobile becomes complicated, various kinds of components are installed in the vicinity of a fuse unit. Hence, in prior art, for the purpose of avoiding the restriction in the peripheral space of such a fuse unit, the terminal provided at an end part of a conducting path is disposed at the predetermined position of the connection section of the fuse unit, and then the terminal is fastened with a bolt to connect the terminal to the connection section, without providing a stud bolt at the connection section of the fuse unit.

Also in recent years, as the electric equipment circuits of an automobile increase in number, the diameter of a conductive path to be connected to the connection section of a fuse unit in prior art tends to become larger. When such a conductive path having a large diameter is bent from a straight state, a force (hereafter referred to as "reaction force") for returning the conductive path to its straight shape before being bent is generated. In the case that the work for connecting the terminal provided at the end part of the conductive path generating the reaction force as described above to the connection section of the fuse unit is carried out, the following problems are caused.

A worker who carries out the work for connecting a terminal to the connection section of a fuse unit bends a conductive path, the end part of which is provided with a terminal, from a straight state, and then places the terminal at the predetermined position of the connection section not provided with the above-mentioned stud bolt. After that, when the worker attempts to pass a bolt through the bolt mounting hole of the terminal and to fasten the bolt, if the worker releases his hand holding the conductive path in its bent state, the conductive path tends to return to its straight shape before being bent due to the reaction force generated in the conductive path. At this time, there is a problem in which the terminal moves in a direction of detaching from the connection section by following the return of the conductive path to its shape before being bent. This causes a problem in which the terminal comes off from the connection section and the workability of the work for fastening the terminal to the connection section of the fuse unit with the bolt becomes low.

Furthermore, even in the case that the above-mentioned reaction force is not generated in the conductive path, when the terminal is placed at the connection section of the fuse unit not provided with a stud bolt, in the case that shocks, vibrations, etc. are exerted from the outside before the bolt is tightened, there is a problem in which the terminal comes off from the connection section. This also causes a problem in which the workability of the work for fastening the terminal to the connection section of the fuse unit with the bolt becomes low.

SUMMARY OF THE INVENTION

The present invention has been made in consideration of the above-mentioned circumstances and is intended to provide a fuse unit capable of facilitating the work for fastening a terminal and the output-side connection section of the fuse unit.

To solve the above-mentioned problems, a fuse unit according to the present invention is provided with a bus bar equipped with a power source-side connection section configured to be connected to a battery terminal, an output-side connection section to which a terminal provided at an end part of a conductive path is connected, and a fusible body that electrically connects the power source-side connection section to the output-side connection section and a housing that covers an outer face of the fusible body of the bus bar so as to expose the power source-side connection section and the output-side connection section of the bus bar, wherein the terminal configured to be connected to the output-side connection section is provided with a bent section formed into a nearly L-shape in a side view and protrusion sections formed so as to protrude from both sides of a tip end section of the terminal; the housing is provided with a terminal accommodation section having an accommodation space capable of accommodating the output-side connection section therein and capable of allowing the terminal to be inserted and accommodated, the accommodation space being enclosed with side walls standing upright on both sides of the output-side connection section in an insertion direction of the terminal and on a deep side thereof in the insertion direction of the terminal; the terminal accommodation section is provided with terminal insertion start-side movement restricting walls that are provided on the respective inner faces of the side walls standing upright on both sides of the output-side connection section in the insertion direction of the terminal so as to be engageable with the protrusion sections of the terminal in a state in which the terminal is accommodated in the accommodation space, thereby restricting the terminal from moving to an insertion start side of the terminal, and spaces between the terminal insertion start-side movement restricting walls and the inner face of the side wall standing upright on the deep side of the output-side connection section in the insertion direction of the terminal are formed as terminal movement restricting grooves so that the protrusion sections of the terminal can be fitted therein in a state in which the terminal is accommodated in the accommodation space, thereby restricting the terminal from moving to the insertion start side of the terminal and in the insertion direction of the terminal; and the terminal accommodation section is further provided with a height-direction and terminal insertion start-side movement restricting wall that is formed so as to connect the side walls standing upright on both the sides of the output-side connection section in the insertion direction of the terminal on the insertion start side of the terminal and so as to be engageable with the bent section of the terminal when the terminal is detached from the output-side connection section, thereby restricting the terminal from moving in the height direction of the side walls and to the insertion start side of the terminal.

With the present invention having the above-mentioned characteristics, when the terminal is inserted and accommodated in the terminal accommodation section, the protrusion sections of the terminal are fitted in the terminal movement restricting grooves. The protrusion sections of the terminal fitted in the terminal movement restricting grooves make contact with the terminal insertion start-side movement restricting walls, the side walls standing upright on both the sides of the output-side connection section in the insertion direction of the terminal, and the side wall standing upright on the deep side of the output-side connection section in the insertion direction of the terminal. Hence, the terminal is restricted from moving to the insertion start side of the terminal, in the insertion direction of the terminal, and in the direction orthogonal to the insertion direction of the terminal. Furthermore, when the terminal is detached from the output-side connection section, the bent section of the terminal is engaged with the height-direction and terminal insertion start-side movement restricting wall. The terminal engaged with the height-direction and terminal insertion start-side movement restricting wall is restricted from moving in the height direction of the side walls and to the insertion start side of the terminal.

For example, in the fuse unit according to the present invention, the distance between the side walls standing upright on the both sides of the output-side connection section in the insertion direction of the terminal is nearly equal to a width of the tip end section of the terminal in a direction orthogonal to an extension direction of the terminal.

With the above-mentioned characteristics, the side walls standing upright on both the sides of the output-side connection section in the insertion direction of the terminal are disposed so that no clearance is provided on both the sides of the tip end section of the terminal.

For example, in the fuse unit according to the present invention, the terminal insertion start-side movement restricting walls and the height-direction and terminal insertion start-side movement restricting wall are each provided with a terminal insertion guide for guiding the insertion of the terminal into the accommodation space; the terminal insertion guide of the terminal insertion start-side movement restricting wall is formed into a curved shape or an inclined shape in cross section at the end section of the upper face of the terminal insertion start-side movement restricting wall on the insertion start side of the terminal; and the terminal insertion guide of the height-direction and terminal insertion start-side movement restricting wall is formed into a curved shape or an inclined shape in cross section at the end section of the inner face of the height-direction and terminal insertion start-side movement restricting wall on the insertion start side of the terminal.

With the present invention having the above-mentioned characteristics, since the terminal insertion start-side movement restricting walls and the height-direction and terminal insertion start-side movement restricting wall are each provided with a terminal insertion guide at the end section thereof on the insertion start side of the terminal, the insertion of the terminal into the terminal accommodation section is started under the guidance of the respective terminal insertion guides.

With the present invention, before the terminal and the output-side connection section are fastened with the bolt, even if the conductive path tries to return to its shape before being bent due to the reaction force generated in the conductive path and the terminal is detached in the height direction of the side walls from the output-side connection section, since the bent section of the terminal is engaged with the height-direction and terminal insertion start-side movement restricting wall, the terminal is restricted from moving in the height direction of the side walls and to the insertion start side of the terminal, whereby the terminal can be prevented from coming off from the output-side connection section. As a result, the present invention exhibits an effect capable of facilitating the work for fastening the terminal and the output-side connection section with the bolt when a reaction force is generated in the conductive path.

Furthermore, with the present invention, even in the case that shocks, vibrations, etc. are exerted from the outside before the terminal and the output-side connection section are fastened with the bolt while no reaction force is generated in the conductive path, the terminal is restricted from moving to the insertion start side of the terminal, in the insertion direction of the terminal and in the direction orthogonal to the insertion direction of the terminal, whereby the terminal can be prevented from coming off from the output-side connection section. Hence, even in the case that shocks, vibrations, etc. are exerted from the outside before the terminal and the output-side connection section are fastened with the bolt while no reaction force is generated in the conductive path, the present invention exhibits an effect capable of facilitating the work for fastening the terminal and the output-side connection section of the fuse unit with the bolt.

With the present invention, the following effect is obtained. In other words, since the side walls standing upright on both the sides of the output-side connection section in the insertion direction of the terminal are disposed so that no clearance is provided on both the sides of the tip end section of the terminal, the distance between the side walls of the terminal accommodation section in the fuse unit according to the present invention can be made smaller than the distance between the side walls that are disposed, for example, so that clearances are provided on both the sides of the tip end section of the terminal. Hence, the present invention exhibits an effect capable of making the whole fuse unit compact.

With the present invention, the following effect is obtained. In other words, since the insertion of the terminal into the terminal accommodation section is started under the guidance of the respective terminal insertion guides, the terminal can be inserted into the terminal accommodation section smoothly. Hence, the present invention exhibits an effect capable of further facilitating the work for connecting the terminal to the output-side connection section.

DETAILED DESCRIPTION OF THE EXEMPLARY EMBODIMENTS

An embodiment of a fuse unit according to the present invention will be described below referring to FIGS. 1 to 8.

Embodiment

Figure 1:
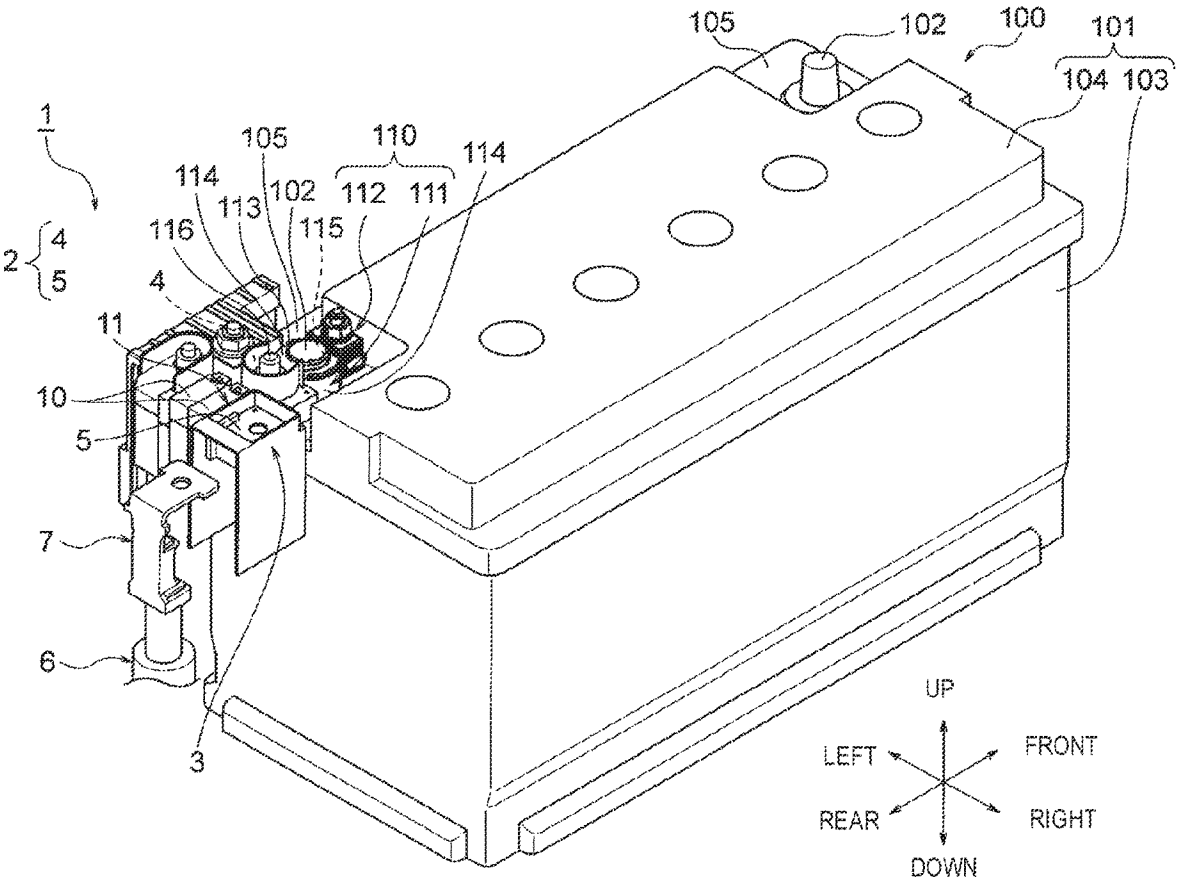
FIG. 1 is a perspective view showing a fuse unit according to the present invention and a battery to which this fuse unit is applied.
Figure 2:
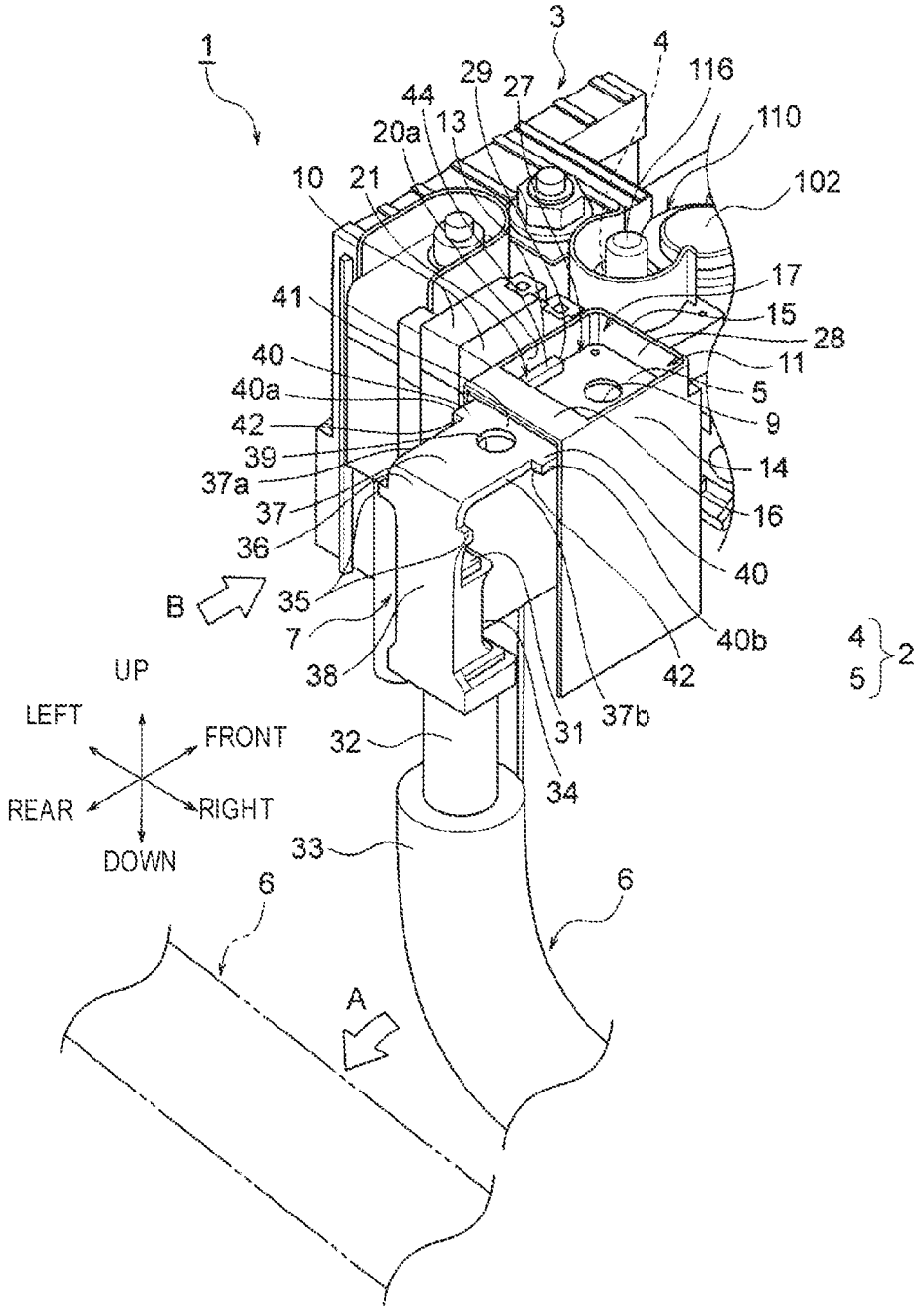
FIG. 2 is an enlarged perspective view showing the fuse unit according to the present invention.
Figure 3A:
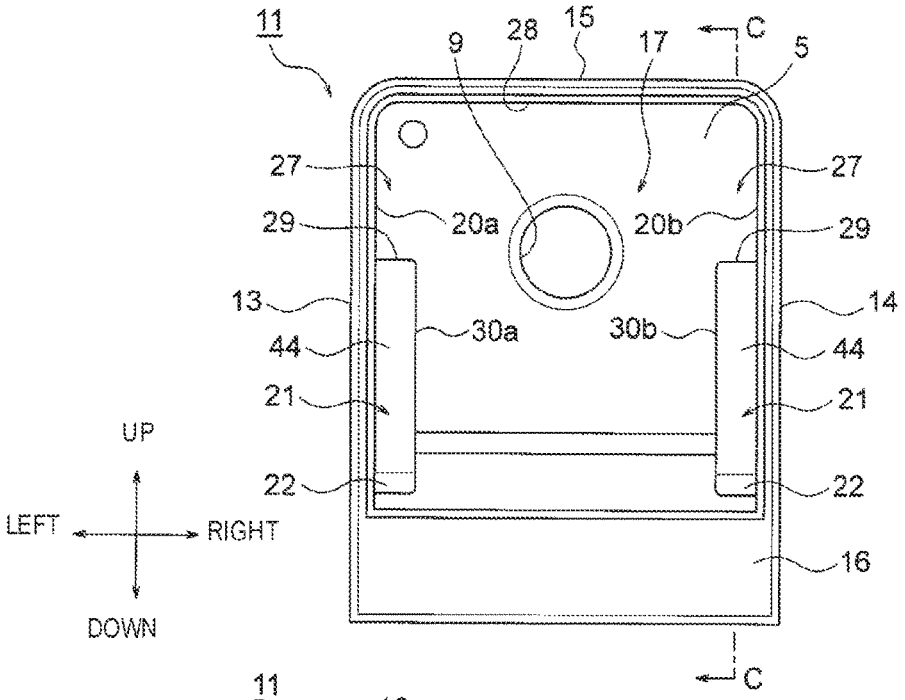
FIG. 3A is a plan view showing the terminal accommodation section of the fuse unit.
Figure 3B:
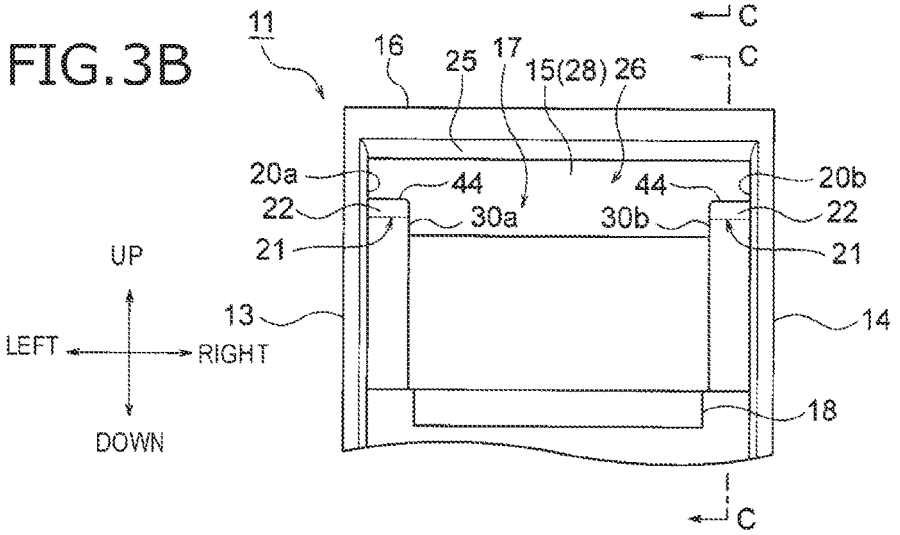
FIG. 3B is a front view showing the terminal accommodation section.
Figure 4:
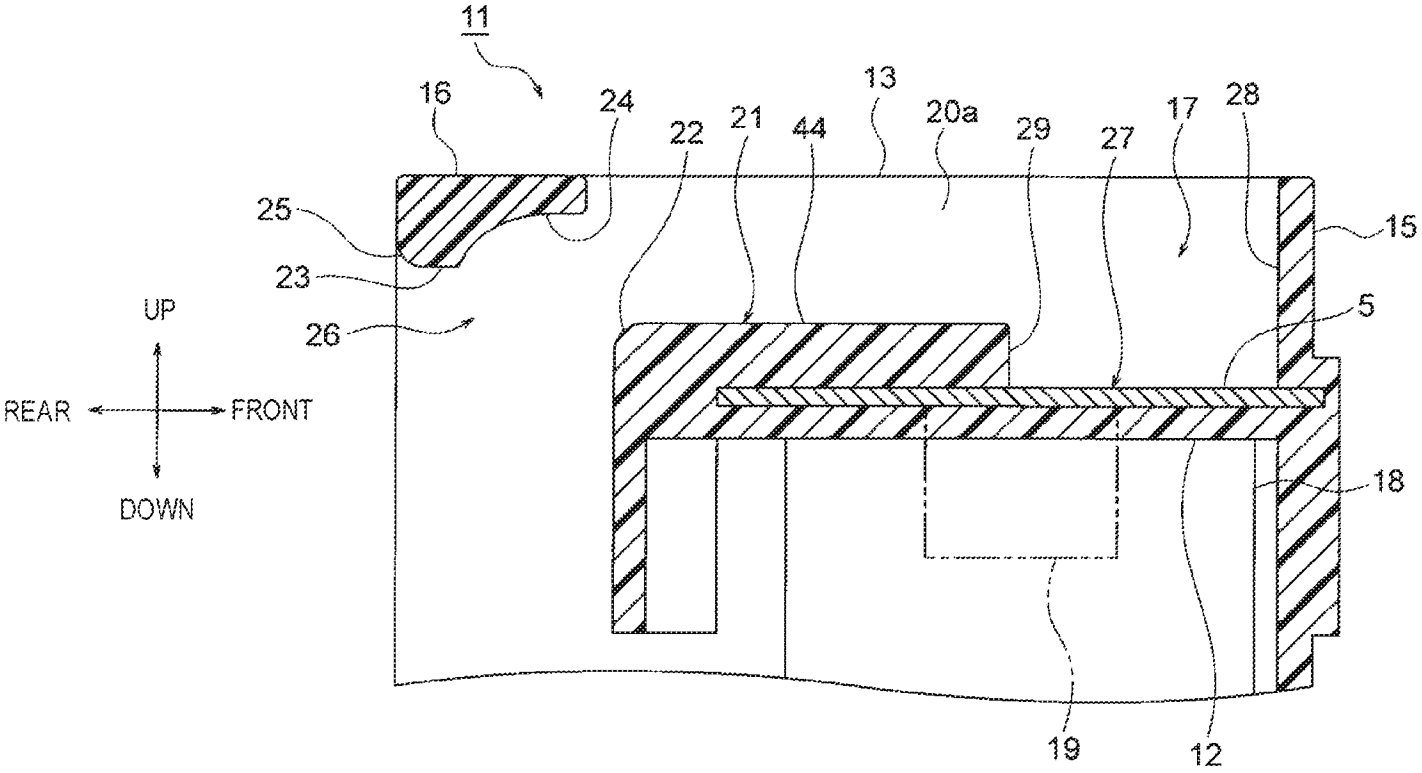
FIG. 4 is a cross-sectional view showing the terminal accommodation section of the fuse unit.
Figure 5:
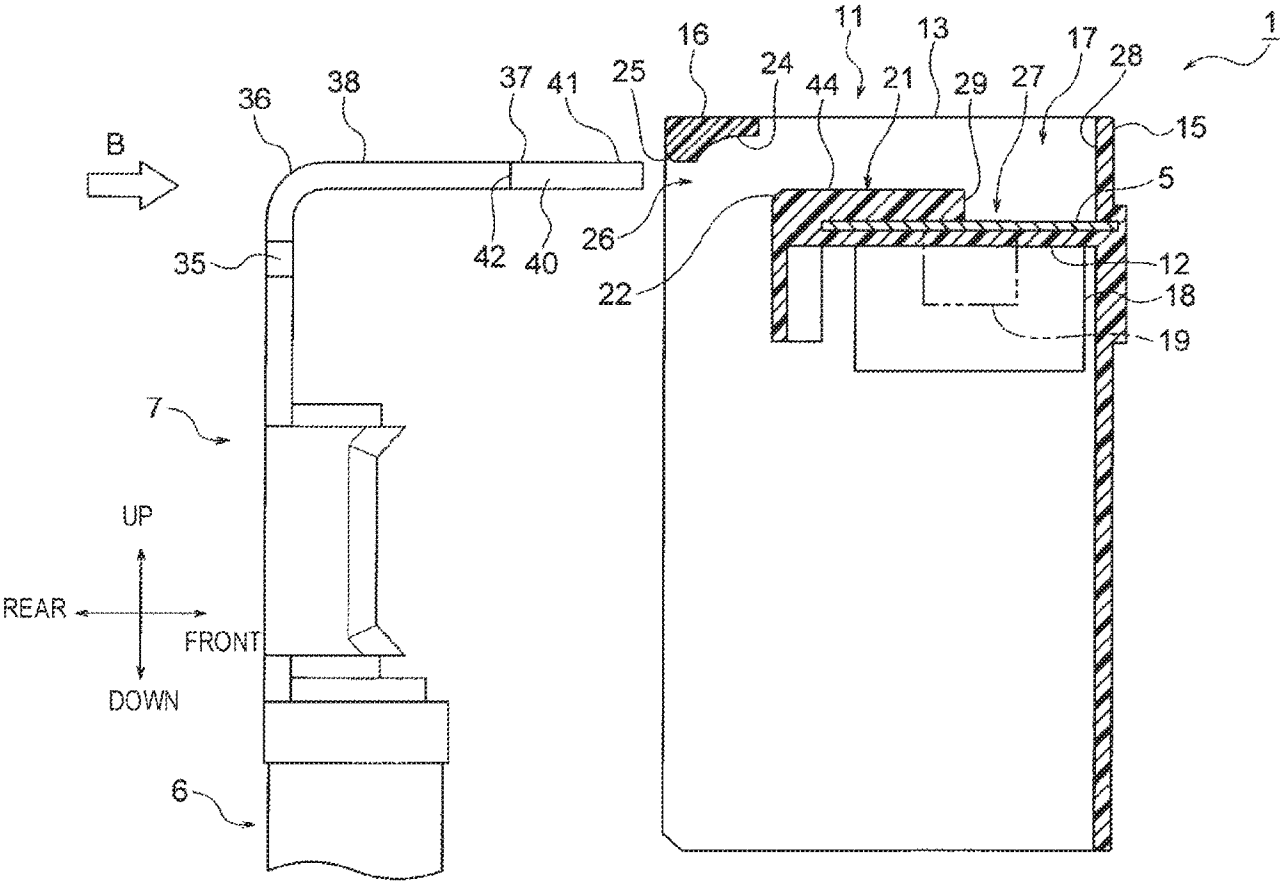
FIG. 5 is a view showing the work for connecting a terminal to an output-side connection section.
Figure 6:
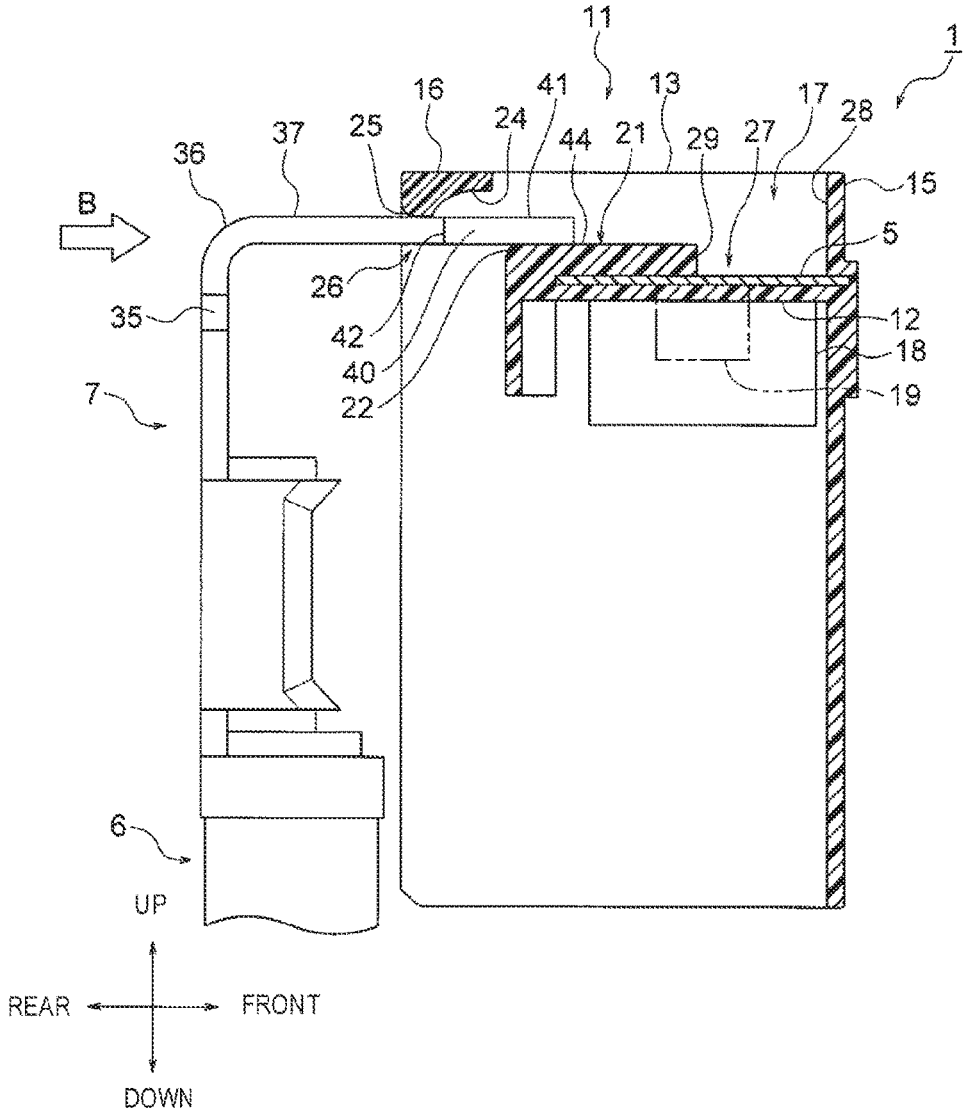
FIG. 6 is a view showing the state following the state shown in FIG. 5.
Figure 7:
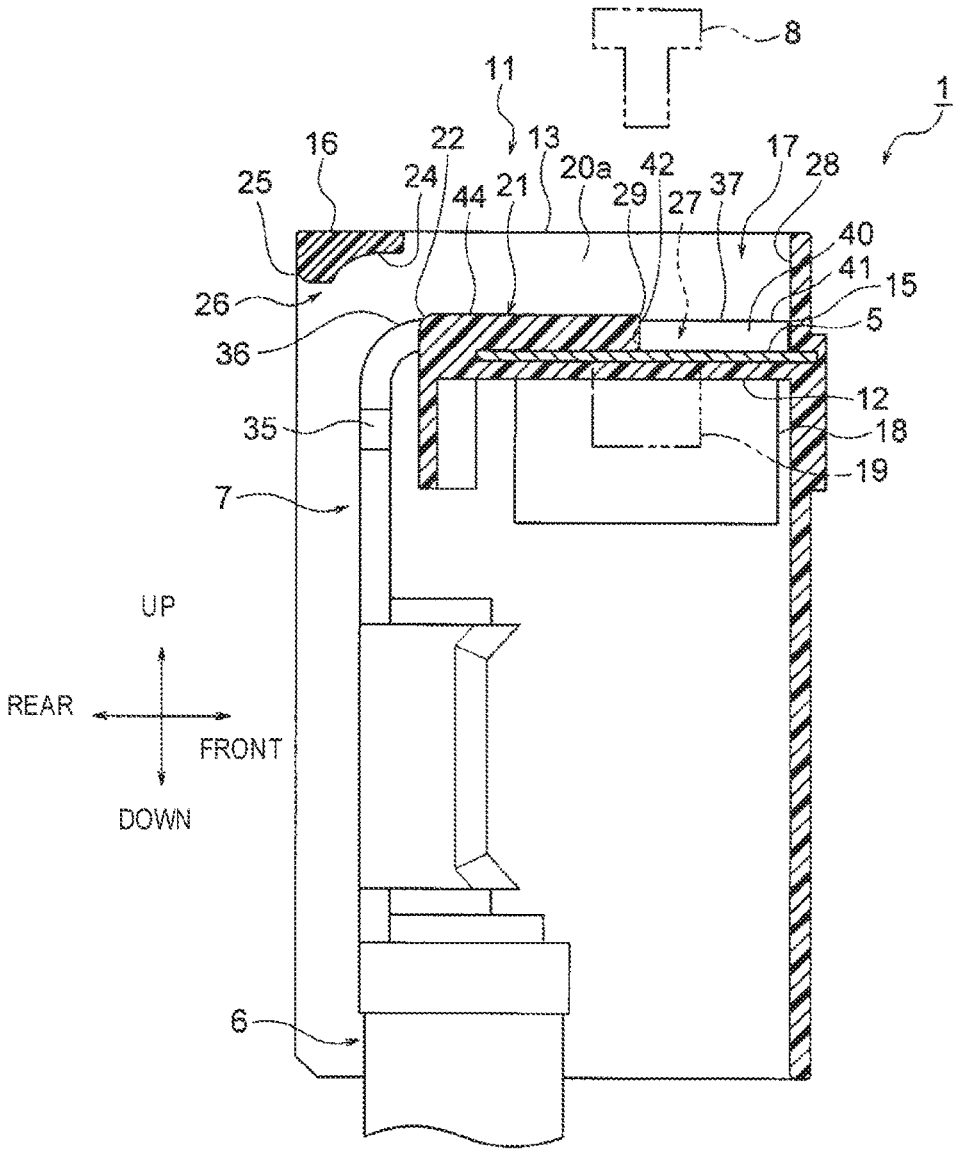
FIG. 7 is a view showing the state following the state shown in FIG. 6.
Figure 8:
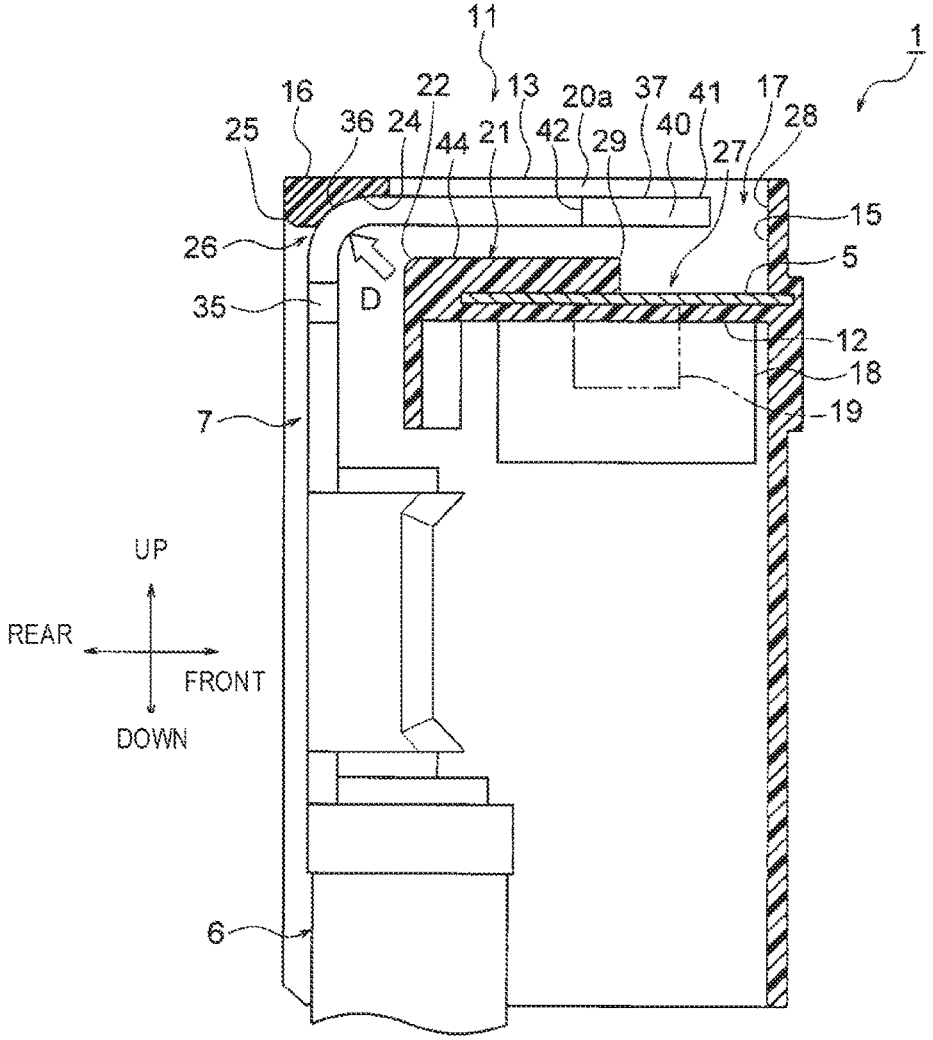
FIG. 8 is a view illustrating the working of the present invention.

FIG. 1 is a perspective view showing a fuse unit according to the present invention and a battery to which this fuse unit is applied; FIG. 2 is an enlarged perspective view showing the fuse unit shown in FIG. 1; FIGS. 3A and 3B are views showing the terminal accommodation section of the fuse unit, FIG. 3A is a plan view showing the terminal accommodation section and FIG. 3B is a front view showing the terminal accommodation section as viewed from the insertion direction of a terminal; FIG. 4 is a cross-sectional view showing the terminal accommodation section shown in FIG. 3A, taken on line C-C of FIG. 3A; FIG. 5 is a cross-sectional view showing the work for connecting the terminal to an output-side connection section, indicating a state before the start of the insertion of the terminal into the terminal accommodation section; FIG. 6 is a cross-sectional view showing the state following the state shown in FIG. 5, indicating a state immediately after the start of the insertion of the terminal into the terminal accommodation section; FIG. 7 is a cross-sectional view showing the state following the state shown in FIG. 6, indicating a state in which the terminal has been accommodated in the terminal accommodation section; and FIG. 8 is a cross-sectional view illustrating the working of the present invention, indicating a state in which, when the terminal is detached from the output-side connection section, the bent section of the terminal is engaged with a height-direction and terminal insertion start-side movement restricting section.

The arrows in these figures indicate up-down, left-right and front-rear directions (it is assumed that the respective directions of the arrows are examples).

In FIG. 1, the reference numeral 1 designates a fuse unit according to the present invention. The fuse unit 1 is applied to a battery terminal 110 connected to a battery 100 mounted on an automobile or the like, and the fusible body thereof is fused to break an electric equipment circuit when an overcurrent flows. First, the battery 100 and the battery terminal 110 to which the fuse unit 1 according to the present invention is applied will be described below. Next, the terminal 7 to be connected to the fuse unit 1 according to the present invention and a conductive path 6 provided with the terminal 7 at its end part will be described below, and the fuse unit 1 according to the present invention will further be described.

First, the battery 100 will be described.

The battery 100 shown in FIG. 1 is composed of a battery housing 101 and a battery post 102 provided on the battery housing 101. The battery housing 101 is composed of a box-shaped housing body 103 having an open upper face and a lid member 104 for closing the open upper face. The battery post 102 is made of lead or the like having conductivity and stands upright on the post standing face 105 of the lid member 104. The battery post 102 has a nearly cylindrical shape and stands upright so as to protrude from the post standing face 105 such that the center axis line thereof is orthogonal to the post standing face 105.

Next, the battery terminal 110 will be described.

The battery terminal 110 shown in FIGS. 1 and 2 is composed of a battery terminal body 111 and a clamp 112. The battery terminal body 111 is formed by press-working a conductive metal plate and is composed of an annular section 113, a pair of clamping sections and an electrical connection section. The annular section 113 is composed of a pair of curved sections 114 disposed so as to be opposed to each other with a predetermined space therebetween and formed so as to be curved to the outside of the battery terminal body 111. The pair of curved sections 114 is formed into a nearly cylindrical shape, and the inside thereof is formed as a battery post insertion hole 115 making face contact with the peripheral side face of the battery post 102. The pair of clamping sections, not shown, is formed continuously from the tip end of the annular section 113, disposed so as to be opposed to each other with a predetermined space therebetween and formed so that the diameter of the battery post insertion hole 115 is reduced when the pair of clamping sections is moved in the direction that they are brought close to each other. The electrical connection section, not shown, is formed continuously from the rear end of the annular section 113, and a stud bolt 116 to be electrically connected to the power source-side connection section 4 of the fuse unit 1 according to the present invention stands upright on the upper face of the electrical connection section. The clamp 112 is provided to reduce the diameter of the battery post insertion hole 115 by moving the pair of clamping sections in the direction that they are brought close to each other.

Next, the conducting path 6 will be described.

The conducting path 6 shown in FIG. 2 is electrically connected to the fuse unit 1 via the terminal 7. In this embodiment, it is assumed that a cable composed of a conductor 31, an insulation coating 32 provided on the conductor 31, and a sheath 33 provided on the insulation coating 32 is used as the conducting path 6. Although it is assumed that a cable having a large diameter is used as the conducting path 6 in this embodiment, it is also assumed that an electric wire having a large diameter may also be used.

Since the conductive path 6 according to this embodiment is large in diameter, when the conductive path 6 being in a straight state (the state of the conductive path 6 indicated by imaginary lines in FIG. 2) is bent to a bent state (the state of the conductive path 6 indicated by solid lines in FIG. 2) as shown in FIG. 2, a force (hereafter referred to as "reaction force") attempting to return the conductive path 6 to its straight shape before being bent is generated in the direction indicated by the arrow A shown in FIG. 2, for example.

Next, the terminal 7 will be described.

As shown in FIG. 2, the terminal 7 is composed of a conductor crimping section 34, nearly intermediate protrusion sections 35, a bent section 36, and an electrical connection section 37. The conductor crimping section 34 is provided as a portion for electrically connecting the conductive path 6 to the terminal 7 and is formed by crimping the conductor 31 using a pair of conductor crimping pieces, not shown, provided at the conductor crimping section 34.

As shown in FIG. 2, the nearly intermediate protrusion sections 35 are provided at the nearly intermediate section of the terminal 7 in the extension direction thereof and are formed so as to protrude from both the sides of the nearly intermediate section in the left-right direction (the direction orthogonal to the extension direction of the terminal 7).

As shown in FIG. 2, the bent section 36 is provided at the nearly intermediate section of the terminal 7 in the extension direction thereof and is formed by bending the terminal 7 into a nearly L-shape in a side view. The bent section 36 is formed such that the cross section of the face serving as the lower face 38 of the terminal 7 has a curved shape.

The electrical connection section 37 is provided on the tip end side of the terminal 7 and is formed as a portion to be electrically connected to the output-side connection section 5 of the fuse unit 1, the output-side connection section 5 being described later. Of the side sections of the electrical connection section 37 shown in FIG. 2, the left side is referred to as a left side section 37*a* and the right side is referred to as a right side section 37*b*. The electrical connection section 37 is provided with a bolt insertion hole 39 and tip-end protrusion sections 40.

The bolt insertion hole 39 is formed so that a bolt 8 (see FIG. 7) for fastening the electrical connection section 37 and the output-side connection section 5 can pass therethrough.

The tip-end protrusion sections 40 are formed so as to protrude in the left-right direction (the direction orthogonal to the extension direction of the terminal 7) from both the sides of the tip end section 41 of the electrical connection section 37 (the tip end section of the terminal 7). The tip-end protrusion sections 40 correspond to the "protrusion sections" in the claims. Of the side sections of the tip-end protrusion sections 40 shown in FIG. 2, the left side is referred to as a left side section 40*a* and the right side is referred to as a right side section 40*b*. The tip-end protrusion sections 40 are formed so as to be engageable with terminal insertion start-side movement restricting walls 21 described later. More specifically, the rear end faces of the tip-end protrusion sections 40 shown in FIG. 2 are formed as the engaging sections 42 to be engaged with the engaging faces 29 of the terminal insertion start-side movement restricting walls 21 described later. The tip-end protrusion sections 40 are formed into a shape so as to be able to be fitted in terminal movement restricting grooves 27 described later. The distance between the tip-end protrusion sections 40 in the direction orthogonal to the extension direction of the terminal 7 is nearly equal to the distance between the nearly intermediate protrusion sections 35 in the direction orthogonal to the extension direction of the terminal 7.

Next, the fuse unit 1 according to the present invention will be described.

The fuse unit 1 shown in FIGS. 1 and 2 is composed of a conductive bus bar 2 and a housing 3 formed so as to cover the outer face of the bus bar 2 and so as to allow part of the bus bar 2 to be exposed. The above-mentioned respective components constituting the fuse unit 1 will be described below.

First, the bus bar 2 will be described.

As shown in FIG. 2, the bus bar 2 is composed of the power source-side connection section 4 to be connected to the battery terminal 110, the output-side connection section 5 to which the terminal 7 provided at the end part of the conductive path 6 is connected, and a fusible body (not shown) for electrically connecting the power source-side connection section 4 and the output-side connection section 5.

The power source-side connection section 4 shown in FIG. 2 is a portion of the bus bar 2 formed so as to be exposed from the housing 3 and is also formed as a portion to which the electrical connection section of the battery terminal 110 is connected. The power source-side connection section 4 is provided with a bolt insertion hole passing therethrough, not shown, into which the stud bolt 116 standing upright on the electrical connection section of the battery terminal 110 can be inserted.

The output-side connection section 5 shown in FIG. 2 is a portion of the bus bar 2 formed so as to be exposed from the housing 3, and is also formed as a portion to which the terminal 7 provided at the end part of the conductive path 6 is connected. The output-side connection section 5 is provided with a bolt insertion hole 9 passing therethrough into which the bolt 8 (see FIG. 7) for fastening the output-side connection section 5 and the terminal 7 can be inserted. The upper face of the output-side connection section 5 is exposed from the housing 3, and the lower face thereof is covered with the housing 3 (the bottom wall 12 of the terminal accommodation section 11 shown in FIG. 4).

The fusible body, not shown, is the so-called fuse that is fused to break an electric equipment circuit when an overcurrent flows.

Next, the housing 3 will be described.

As shown in FIG. 2, the housing 3 is formed so as to cover the outer face of the bus bar 2 including the fusible body by insert molding and is also formed so as to allow the power-source side connection section 4 and the upper face of the output-side connection section 5 to be exposed. The housing 3 is composed of a fuse section 10 and the terminal accommodation section 11 adjacent to the fuse section 10.

As shown in FIG. 2, the fuse section 10 has a configuration in which a cover formed of a transparent insulating resin material is fitted on the outer face of the fusible body.

As shown in FIG. 2, the terminal accommodation section 11 is formed into a nearly rectangular box shape with the upper face and the rear race thereof opened and is also formed so as to enclose the output-side connection section 5 that is exposed from the housing 3. The terminal accommodation section 11 is composed of the bottom wall 12 (see FIG. 4), a first side wall 13, a second side wall 14, a third side wall 15, a height-direction and terminal insertion start-side movement restricting wall 16, and an accommodation space 17.

The bottom wall 12 shown in FIG. 4 is provided as a portion for covering the lower face of the output-side connection section 5. The lower side of the bottom wall 12 is provided with a nut embedded section 18. As shown in FIG. 4, a nut 19 that can be thread-engaged with the bolt 8 is embedded in the bottom wall 12 and the nut embedded section 18 by insert molding. The nut 19 is disposed directly under the bolt insertion hole 9 provided in the output-side connection section 5 in the center axis direction thereof.

The first side wall 13 and the second side wall 14 shown in FIGS. 2 and 3A and 3B are formed continuously from the bottom wall 12 and stand upright so as to be disposed as opposed to each other with the output-side connection section 5 being located therebetween in the left-right direction (the direction orthogonal to the insertion direction of the terminal 7 (the direction indicated by the arrow B shown in FIG. 2)). The first side wall 13 and the second side wall 14 correspond to "the side walls standing upright on both the sides of the output-side connection section in the insertion direction of the terminal" in the claims.

The distance between the inner face 20*a* of the first side wall 13 and the inner face 20*b* of the second side wall 14 shown in FIG. 3A is nearly equal to the distance between the tip-end protrusion sections 40 and the distance between the nearly intermediate protrusion sections 35 of the terminal 7 shown in FIG. 2 in the direction orthogonal to the extension direction of the terminal 7 (the insertion direction of the terminal 7 (the direction indicated by the arrow B shown in FIG. 2)). The distance between the inner face 20*a* of the first side wall 13 and the inner face 20*b* of the second side wall 14 having been set as described above has a dimension such that the tip-end protrusion sections 40 and the nearly intermediate protrusion sections 35 of the terminal 7 make contact with the inner face 20*a* of the first side wall 13 and the inner face 20*b* of the second side wall 14 in a state in which the terminal 7 is inserted in the terminal accommodation section 11 (the accommodation space 17) or has a dimension such that the protrusion sections are disposed close to the inner faces with a slight clearance.

As shown in FIGS. 2, 3A and 3B, the terminal insertion start-side movement restricting walls 21 are provided at the nearly intermediate sections of the inner face 20*a* of the first side wall 13 and the inner face 20*b* of the second side wall 14 in the front-rear direction thereof (the insertion direction of the terminal 7 (the direction indicated by the arrow B shown in FIG. 2)). The terminal insertion start-side movement restricting walls 21 are provided as portions for restricting the terminal 7 having been formed so as to be engageable therewith from moving to the insertion start side of the terminal 7 (the rear side in FIG. 2) in a state in which the terminal 7 is accommodated in the accommodation space 17. It is assumed herein that the above-mentioned "state in which the terminal 7 is accommodated in the accommodation space 17" is a state (see FIG. 7) in which the electrical connection section 37 of the terminal 7 inserted in the accommodation space 17 is placed on the upper face of the output-side connection section 5.

As shown in FIGS. 3A and 4, the end faces of the terminal insertion start-side movement restricting walls 21 in the insertion direction of the terminal 7 (the front side in FIGS. 3A and 4) are formed as engaging faces 29. The engaging faces 29 are provided as portions that can be engaged with the engaging sections 42 formed at the tip-end protrusion sections 40 of the terminal 7 shown in FIG. 2.

As shown in FIGS. 3A, 3B and 4, terminal insertion guides 22 are provided at the end sections of the upper faces 44 of the terminal insertion start-side movement restricting walls 21 on the insertion start side of the terminal 7 (the rear side in FIGS. 3A and 4). The terminal insertion guides 22 are provided as portions for guiding the insertion of the terminal 7 into the accommodation space 17. Although the terminal insertion guide 22 is formed into a curved shape so as to have an upward protruding curve in cross section as shown in FIG. 4 in this embodiment, the terminal insertion guide 22 is not limited to have this shape. The terminal insertion guide 22 may be formed into other shapes, such as a tapered shape inclined upward in the insertion direction of the terminal 7.

The third side wall 15 shown in FIGS. 2 to 4 is formed continuously from the bottom wall 12 and stands upright on the front end side of the output-side connection section 5 (the deep side in the insertion direction of the terminal 7 (the direction indicated by the arrow B shown in FIG. 2)). The left side of the third side wall 15 is formed continuously from the first side wall 13, and the right side thereof is formed continuously from the second side wall 14. The third side wall 15 corresponds to "the side wall standing upright on the deep side of the output-side connection section in the insertion direction of the terminal" in the claims.

As shown in FIGS. 2 to 4, the height-direction and terminal insertion start-side movement restricting wall 16 is formed so as to connect the upper edge sections of the first side wall 13 and the second side wall 14 to each other on the insertion start side of the terminal 7 (the rear side in FIGS. 2 to 4). The height-direction and terminal insertion start-side movement restricting wall 16 is formed so as to be engageable with the terminal 7 in the case that the terminal 7 is detached from the output-side connection section 5 in an upward direction (the height direction of the first side wall 13, the second side wall 14 and the third side wall 15), whereby the height-direction and terminal insertion start-side movement restricting wall 16 is provided as a portion for restricting the terminal 7 from moving in the upward direction and to the insertion start side of the terminal 7.

As shown in FIG. 4, a height-direction and terminal insertion start-side movement restricting section 24 and a terminal insertion guide 25 are provided along the entire length of the inner face (lower face) 23 of the height-direction and terminal insertion start-side movement restricting wall 16 in the left-right direction (the direction from the front side to the back side of the paper on which FIG. 4 is drawn).

The height-direction and terminal insertion start-side movement restricting section 24 shown in FIG. 4 is provided as a portion formed so as to be engageable with the bent section 36 of the terminal 7 in the case that the terminal 7 is detached from the output-side connection section 5 in an upward direction (the height direction of the first side wall 13, the second side wall 14 and the third side wall 15) (see FIG. 8). As shown in FIG. 4, the height-direction and terminal insertion start-side movement restricting section 24 is formed into a concave shape in cross section in the direction from the front end of the height-direction and terminal insertion start-side movement restricting wall 16 to the nearly intermediate section of the height-direction and terminal insertion start-side movement restricting wall 16, thereby being formed into a curved shape with which the bent section 36 of the terminal 7 can make face contact.

The terminal insertion guide 25 shown in FIG. 4 is provided at the end section of the height-direction and terminal insertion start-side movement restricting wall 16 on the insertion start side of the terminal 7 (the rear side in FIG. 4). The terminal insertion guide 25 is provided as a portion for guiding the insertion of the terminal 7 into the accommodation space 17. Although the terminal insertion guide 25 is formed into a curved shape so as to have a downward protruding curve in cross section as shown in FIG. 4 in this embodiment, the terminal insertion guide 25 is not limited to have this shape. The terminal insertion guide 25 may be formed into other shapes, such as a tapered shape inclined downward in the insertion direction of the terminal 7.

As shown in FIGS. 2 to 4, the accommodation space 17 is the internal space of the terminal accommodation section 11 and is formed as a space capable of accommodating the output-side connection section 5 inside and capable of allowing the terminal 7 to be inserted and accommodated. The accommodation space 17 is enclosed with the first side wall 13, the second side wall 14 and the third side wall 15. The accommodation space 17 is equipped with a terminal insertion port 26 and the terminal movement restricting grooves 27.

As shown in FIGS. 3A, 3B and 4, the terminal insertion port 26 is an open portion in the terminal accommodation section 11 on the insertion start side of the terminal 7 (the rear side in FIG. 4) and is formed as an inlet communicating with the accommodation space 17 and allowing the terminal 7 to be inserted into the accommodation space 17. As shown in FIG. 4, the terminal insertion guide 25 of the height-direction and terminal insertion start-side movement restricting wall 16 is disposed on the upper side of the terminal insertion port 26, and the terminal insertion guides 22 of the terminal insertion start-side movement restricting walls 21 are disposed on the lower side of the terminal insertion port 26.

As shown in FIGS. 2 to 4, the terminal movement restricting grooves 27 are spaces (the spaces between the engaging faces 29 of the terminal insertion start-side movement restricting walls 21 and the inner face 28 of the third side wall 15) enclosed with the inner face 20*a* of the first side wall 13, the inner face 20*b* of the second side wall 14, the engaging faces 29 of the terminal insertion start-side movement restricting walls 21 and the inner face 28 of the third side wall 15. The terminal movement restricting grooves 27 are provided as portions for restricting the movement of the terminal 7 to the insertion start side of the terminal 7 (the rear side in FIG. 2) and in the insertion direction of the terminal (the direction indicated by the arrow B shown in FIG. 2).

The terminal movement restricting grooves 27 are formed so that the tip-end protrusion sections 40 of the terminal 7 can be fitted in the grooves in a state in which the electrical connection section 37 of the terminal 7 is accommodated in the accommodation space 17. More specifically, the distance between the engaging face 29 of the terminal insertion start-side movement restricting wall 21 and the inner face 28 of the third side wall 15 is nearly equal to the width of the tip-end protrusion section 40 in the extension direction of the terminal 7 (the insertion direction of the terminal 7 (the direction indicated by the arrow B shown in FIG. 2)). Furthermore, the depth of the terminal movement restricting groove 27 (in the terminal movement restricting groove 27 disposed on the left side in FIG. 3A, the distance from the position of the inner face 30*a* of the terminal insertion start-side movement restricting wall 21 to the inner face 20*a* of the first side wall 13 (in the terminal movement restricting groove 27 disposed on the right side in FIG. 3A, the distance from the position of the inner face 30*b* of the terminal insertion start-side movement restricting wall 21 to the inner face 20*b* of the second side wall 14)) is nearly equal to the protruding amount of the tip-end protrusion section 40 from the electrical connection section 37 of the terminal 7 (the length protruding from the left side section 37*a* (the right side section 37*b*) of the electrical connection section 37)). In a state in which the tip-end protrusion sections 40 of the terminal 7 are fitted in the terminal movement restricting grooves 27, the terminal movement restricting grooves 27 having been set as described above have dimensions such that the tip-end protrusion sections 40 make contact with the inner face 20*a* of the first side wall 13, the inner face 20*b* of the second side wall 14, the engaging faces 29 of the terminal insertion start-side movement restricting walls 21 and the inner face 28 of the third side wall 15.

In the accommodation space 17, the width of the space between the inner face 30*a* of the terminal insertion start-side movement restricting wall 21 provided on the first side wall 13 and the inner face 30*b* of the terminal insertion start-side movement restricting wall 21 provided on the second side wall 14 in the left-right direction (the insertion direction of the terminal 7 (the direction indicated by the arrow B shown in FIG. 2)) is nearly equal to the width of the portion of the electrical connection section 37 not provided with the tip-end protrusion sections 40 in the direction orthogonal to the extension direction of the terminal 7 (the insertion direction of the terminal 7 (the direction indicated by the arrow B shown in FIG. 2)). In a state in which the terminal 7 is accommodated in the accommodation space 17, the accommodation space 17 having set as described above has dimensions such that the left side section 37*a* of the electrical connection section 37 makes contact with the inner face 30*a* of the terminal insertion start-side movement restricting wall 21 provided on the first side wall 13 and such that the right side section 37*b* of the electrical connection section 37 makes contact with the inner face 30*b* of the terminal insertion start-side movement restricting wall 21 provided on the second side wall 14.

Next, the work procedure for connecting the fuse unit 1 according to the present invention to the terminal 7 provided at the end part of the conductive path 6 will be described.

First, as shown in FIGS. 2 and 5, in a state in which the lower face 38 of the terminal 7 is directed upward, the terminal 7 having been connected to the end part of the conductive path 6 by crimping is moved in the insertion direction of the terminal 7 (the direction indicated by the arrow B shown in FIGS. 2 and 5) and inserted into the terminal insertion port 26 of the terminal accommodation section 11 from the side of the electrical connection section 37, whereby the insertion of the terminal 7 into the terminal accommodation section 11 is started.

At this time, even in the case that an attempt is made to start the insertion of the terminal 7 in a state in which the height position of the electrical connection section 37 of the terminal 7 shown in FIG. 5 is slightly displaced upward from the terminal insertion port 26, the tip end of the electrical connection section 37 makes slide contact with the terminal insertion guide 25 of the height-direction and terminal insertion start-side movement restricting wall 16, whereby the tip end is guided to the appropriate height position of the electrical connection section 37 and the insertion of the terminal 7 can be started. Furthermore, even in the case that an attempt is made to start the insertion of the terminal 7 in a state in which the height position of the electrical connection section 37 of the terminal 7 shown in FIG. 5 is slightly displaced downward from the terminal insertion port 26, the tip end of the electrical connection section 37 makes slide contact with the terminal insertion guides 22 of the terminal insertion start-side movement restricting walls 21, whereby the tip end is guided to the appropriate height position of the electrical connection section 37 and the insertion of the terminal 7 can be started.

After the start of the insertion of the terminal 7, the terminal 7 is continuously inserted in the insertion direction of the terminal 7 (the direction indicated by the arrow B shown in FIG. 6) as shown in FIG. 6. After the tip-end protrusion sections 40 of the terminal 7 have reached the upper faces 44 of the terminal insertion start-side movement restricting walls 21, the tip-end protrusion sections 40 are made slide contact with the upper faces 44 of the terminal insertion start-side movement restricting walls 21, and the terminal 7 is inserted until the tip end section 41 of the electrical connection section 37 makes contact with the inner face 28 of the third side wall 15.

When the tip end of the terminal 7 (the electrical connection section 37) makes contact with the inner face 28 of the third side wall 15, the tip-end protrusion sections 40 of the terminal 7 have finished passing through the upper faces 44 of the terminal insertion start-side movement restricting walls 21. In other words, the tip-end protrusion sections 40 are positioned directly above the terminal movement restricting grooves 27.

After that, when the terminal 7 is moved downward, the tip-end protrusion sections 40 fall down into the terminal movement restricting grooves 27, whereby the tip-end protrusion sections 40 are fitted in the terminal movement restricting grooves 27 as shown in FIG. 7. Hence, the engaging sections 42 of the tip-end protrusion sections 40 are engaged with the engaging faces 29 of the terminal insertion start-side movement restricting walls 21. At this time, the portions of the electrical connection section 37 not provided with the tip-end protrusion sections 40 also fall down into the space (see FIGS. 3A and 3B) between the inner face 30*a* of the terminal insertion start-side movement restricting wall 21 provided on the first side wall 13 and the inner face 30*b* the terminal insertion start-side movement restricting wall 21 provided on the second side wall 14, although this state is not shown. Hence, the electrical connection section 37 of the inserted terminal 7 is in a state of being placed on the upper face of the output-side connection section 5. Consequently, the terminal 7 is in a state of being accommodated in the accommodation space 17.

After that, the work for fastening the terminal 7 and the output-side connection section 5 with the bolt 8 is carried out. The bolt 8 shown in FIG. 7 is inserted into the bolt insertion hole 39 of the electrical connection section 37 and the bolt insertion hole 9 of the output-side connection section 5. The bolt 8 is then thread-engaged with the nut 19. Hence, the fastening of the electrical connection section 37 and the output-side connection section 5 with the bolt 8 is completed, whereby the electrical connection section 37 is electrically connected to the output-side connection section 5. Consequently, the work for connecting the fuse unit 1 according to the present invention to the terminal 7 provided at the end part of the conductive path 6 is completed.

Next, the working of the fuse unit 1 according to the present invention in the case that the terminal 7 is detached from the output-side connection section 5 due to the reaction force generated in the conductive path 6 will be described.

As shown in FIG. 2, in the case that the conductive path 6 having a large diameter is bent from a straight state (see FIG. 2 showing the conductive path 6 indicated by imaginary lines) and the terminal 7 is accommodated in the accommodation space 17, a force (reaction force) for returning the conductive path 6 to its straight shape before being bent is generated. Hence, in a state before the electrical connection section 37 of the terminal 7 and the output-side connection section 5 are fastened with the bolt 8 as shown in FIG. 7, the terminal 7 is detached from the output-side connection section 5 in the direction indicated by the arrow D shown in FIG. 8.

With the fuse unit 1 according to the present invention, when the terminal 7 is detached from the output-side connection section 5 as shown in FIG. 8, the bent section 36 of the terminal 7 is engaged with the height-direction and terminal insertion start-side movement restricting section 24 of the height-direction and terminal insertion start-side movement restricting wall 16. As a result, the terminal 7 can be restricted from moving upward (in the height direction of the first side wall 13, the second side wall 14 and the third side wall 15) and to the insertion start side of the terminal 7 (the rear side in FIG. 8).

Furthermore, the distance between the inner face 20*a* of the first side wall 13 and the inner face 20*b* of the second side wall 14 is nearly equal to the distance between the tip-end protrusion sections 40 and the distance between the nearly intermediate protrusion sections 35 of the terminal 7 in the direction orthogonal to the extension direction of the terminal 7. Hence, even in the case that the terminal 7 is detached from the output-side connection section 5, the tip-end protrusion sections 40 and the nearly intermediate protrusion sections 35 of the terminal 7 make contact with the inner face 20*a* of the first side wall 13 and the inner face 20*b* of the second side wall 14. As a result, the terminal 7 can be restricted from moving in the left-right direction (the direction from the front side to the back side of the paper on which FIG. 8 is drawn).

Moreover, as shown in FIG. 8, in the case that the terminal 7 is detached from the output-side connection section 5, the terminal 7 can move in the insertion direction of the terminal 7 (to the front side in FIG. 8). However, since the tip end section 41 of the electrical connection section 37 makes contact with the inner face 28 of the third side wall 15, the terminal 7 can be restricted from moving further in the above-mentioned insertion direction.

Still further, as shown in FIG. 8, in the case that the terminal 7 is detached from the output-side connection section 5, the terminal 7 can move downward. However, since the electrical connection section 37 makes contact with the upper faces 44 of the terminal insertion start-side movement restricting walls 21 or the upper face of the output-side connection section 5, the terminal 7 can be restricted from moving further downward.

As described above, with the fuse unit 1 according to the present invention, in the case that a reaction force is generated in the conductive path 6 and in a state before the electrical connection section 37 of the terminal 7 and the output-side connection section 5 are fastened with the bolt 8, the terminal 7 can be restricted from moving in the above-mentioned respective directions.

Next, the working of the fuse unit 1 according to the present invention will be described below in a state in which the terminal 7 is accommodated in the accommodation space 17 (in a state in which the tip-end protrusion sections 40 of the terminal 7 are fitted in the terminal movement restricting grooves 27) while no reaction force is generated in the conductive path 6 and in the case that shocks, vibrations, etc. are exerted from the outside.

As shown in FIG. 7, in a state in which the terminal 7 is accommodated in the accommodation space 17 and in a state before the electrical connection section 37 of the terminal 7 and the output-side connection section 5 are fastened with the bolt 8, in the case that shocks, vibrations, etc. are exerted from the outside, it is conceivable that the terminal 7 may tend to move to the insertion start side thereof (the rear side in FIG. 7). However, even if the terminal 7 tends to move to the insertion start side (the rear side in FIG. 7) at this time, with the fuse unit 1 according to the present invention, the engaging sections 42 of the tip-end protrusion sections 40 of the terminal 7 are engaged with the engaging faces 29 of the terminal insertion start-side movement restricting walls 21, whereby the terminal 7 can be restricted from moving to the above-mentioned insertion start side.

Furthermore, since the tip end section 41 of the electrical connection section 37 makes contact with the inner face 28 of the third side wall 15 as shown in FIG. 7, even if shocks, vibrations, etc. are exerted from the outside, the terminal 7 can be restricted from moving in the insertion direction of the terminal 7 (the front side in FIG. 7).

Moreover, since the distance between the inner face 20*a* of the first side wall 13 and the inner face 20*b* of the second side wall 14 is nearly equal to the distance between the tip-end protrusion sections 40 and the distance between the nearly intermediate protrusion sections 35 of the terminal 7 in the direction orthogonal to the extension direction of the terminal 7, the tip-end protrusion sections 40 and the nearly intermediate protrusion sections 35 of the terminal 7 make contact with the inner face 20*a* of the first side wall 13 and the inner face 20*b* of the second side wall 14. Besides, the left side section 40*a* of the electrical connection section 37 of the terminal 7 makes contact with the inner face 20*a* of the first side wall 13, and the right side section 40*b* of the electrical connection section 37 makes contact with the inner face 20*b* of the second side wall 14. Hence, even if shocks, vibrations, etc. are exerted from the outside, the terminal 7 can be restricted from moving in the left-right direction (the direction from the front side to the back side of the paper on which FIG. 7 is drawn).

Further, in FIG. 7, even in the case that the terminal 7 is detached from the output-side connection section 5 upward (in the height direction of the first side wall 13, the second side wall 14 and the third side wall 15) by shocks, vibrations, etc. exerted from the outside, since the terminal 7 makes contact with the terminal insertion guide 25 of the height-direction and terminal insertion start-side movement restricting wall 16, the terminal 7 can be restricted from moving in the height direction. Furthermore, even if the terminal 7 tends to move to the insertion start side of the terminal 7 (the rear side in FIG. 7), the terminal 7 can be restricted from moving to the above-mentioned insertion start side by the height-direction and terminal insertion start-side movement restricting wall 16.

Still further, in FIG. 7, since the terminal 7 makes contact with the upper face of the output-side connection section 5, even if shocks, vibrations, etc. are exerted from the outside, the terminal 7 can be restricted from moving downward.

As described above, with the fuse unit 1 according to the present invention, in a state in which the terminal 7 is accommodated in the accommodation space 17 and in a state before the electrical connection section 37 of the terminal 7 and the output-side connection section 5 are fastened with the bolt 8 while no reaction force is generated in the conductive path 6, even in the case that shocks, vibrations, etc. are exerted from the outside, the terminal 7 can be restricted from moving in the above-mentioned respective directions.

Next the effects of the fuse unit 1 according to the present invention will be described.

As described above referring to FIGS. 1 to 8, with the present invention, before the terminal 7 and the output-side connection section 5 are fastened with the bolt 8, even if the conductive path 6 tries to return to its shape before being bent due to the reaction force generated in the conductive path 6 and the terminal 7 is detached in the height direction of the first side wall 13, the second side wall 14 and the third side wall 15 from the output-side connection section 5, since the bent section 36 of the terminal 7 is engaged with the height-direction and terminal insertion start-side movement restricting wall 16, the terminal 7 is restricted from moving in the above-mentioned height direction and to the above-mentioned insertion start side of the terminal 7 (the rear side in FIG. 7), whereby the terminal 7 can be prevented from coming off from the output-side connection section 5. As a result, the present invention exhibits an effect capable of facilitating the work for fastening the terminal 7 and the output-side connection section 5 with the bolt 8 when a reaction force is generated in the conductive path 6.

Furthermore, with the present invention, even in the case that shocks, vibrations, etc. are exerted from the outside before the terminal 7 and the output-side connection section 5 are fastened with the bolt 8 while no reaction force is generated in the conductive path 6, the terminal 7 is restricted from moving to the insertion start side of the terminal 7 (the rear side in FIG. 7), in the insertion direction of the terminal 7 and in the direction orthogonal to the insertion direction of the terminal 7, whereby the terminal 7 can be prevented from coming off from the output-side connection section 5. Hence, even in the case that shocks, vibrations, etc. are exerted from the outside before the terminal 7 and the output-side connection section 5 are fastened with the bolt 8 while no reaction force is generated in the conductive path 6, the present invention exhibits an effect capable of facilitating the work for fastening the terminal 7 and the output-side connection section 5 with the bolt 8.

Moreover, with the present invention, the following effect is obtained in addition to the above-mentioned effect. In other words, since the side walls (the first side wall 13 and the second side wall 14) standing upright on both the sides of the output-side connection section 5 in the insertion direction of the terminal 7 are disposed so that no clearance is provided on both the sides of the tip end section 41 of the terminal 7, the distance between the side walls 13 and 14 of the terminal accommodation section 11 in the fuse unit 1 according to the present invention can be made smaller than the distance between the side walls 13 and 14 that are disposed, for example, so that clearances are provided on both the sides of the tip end section 41 of the terminal 7. Hence, the present invention exhibits an effect capable of making the whole fuse unit 1 compact.

Further, with the present invention, the following effect is obtained in addition to the above-mentioned effects. In other words, since the insertion of the terminal 7 into the terminal accommodation section 11 is started under the guidance of the respective terminal insertion guides 22 and 25, the terminal 7 can be inserted into the terminal accommodation section 11 smoothly. Hence, the present invention exhibits an effect capable of further facilitating the work for connecting the terminal 7 to the output-side connection section 5.

Still further, the present invention can be modified variously without departing from the gist of the invention as a matter of course.

What is claimed is:

1. A fuse unit comprising:

a bus bar including:

a power source-side connection section configured to be connected to a battery terminal;

an output-side connection section to which a terminal provided at an end part of a conductive path is connected; and a fusible body that electrically connects the power source-side connection section to the output-side connection section; and a housing that covers an outer face of the fusible body of the bus bar so as to expose the power source-side connection section and the output-side connection section of the bus bar, wherein:

the terminal configured to be connected to the output-side connection section comprises:

a bent section formed into a nearly L-shape in a side view; and protrusion sections formed so as to protrude from both sides of a tip end section of the terminal, the housing comprises a terminal accommodation section having an accommodation space capable of accommodating the output-side connection section therein and capable of allowing the terminal to be inserted and accommodated, the accommodation space being enclosed with side walls standing upright on both sides of the output-side connection section in an insertion direction of the terminal and on a deep side thereof in the insertion direction of the terminal, the terminal accommodation section comprises terminal insertion start-side movement restricting walls that are provided on respective inner faces of the side walls standing upright on both sides of the output-side connection section in the insertion direction of the terminal so as to be engageable with the protrusion sections of the terminal in a state in which the terminal is accommodated in the accommodation space, thereby restricting the terminal from moving to an insertion start side of the terminal, and spaces between the terminal insertion start-side movement restricting walls and the inner face of the side wall standing upright on the deep side of the output-side connection section in the insertion direction of the terminal are formed as terminal movement restricting grooves so that the protrusion sections of the terminal can be fitted therein in a state in which the terminal is accommodated in the accommodation space, thereby restricting the terminal from moving to the insertion start side of the terminal and in the insertion direction of the terminal, and the terminal accommodation section further comprises a height-direction and terminal insertion start-side movement restricting wall that is provided so as to connect the side walls standing upright on both sides of the output-side connection section in the insertion direction of the terminal on the insertion start side of the terminal and so as to be engageable with the bent section of the terminal when the terminal is detached from the output-side connection section, thereby restricting the terminal from moving in the height direction of the side walls and to the insertion start side of the terminal.

2. The fuse unit according to claim 1, wherein:

the distance between the side walls standing upright on the both sides of the output-side connection section in the insertion direction of the terminal is nearly equal to a width of the tip end section of the terminal in a direction orthogonal to an extension direction of the terminal.

3. The fuse unit according to claim 1, wherein:

the terminal insertion start-side movement restricting walls and the height-direction and terminal insertion start-side movement restricting wall are each provided with a terminal insertion guide for guiding the insertion of the terminal into the accommodation space, the terminal insertion guide of the terminal insertion start-side movement restricting wall is formed into a curved shape or an inclined shape in cross section at the end section of the upper face of the terminal insertion start-side movement restricting wall on the insertion start side of the terminal, and the terminal insertion guide of the height-direction and terminal insertion start-side movement restricting wall is formed into a curved shape or an inclined shape in cross section at the end section of the inner face of the height-direction and terminal insertion start-side movement restricting wall on the insertion start side of the terminal.

* * * * *